US012628873B2

(12) United States Patent
Moloney et al.

(10) Patent No.: US 12,628,873 B2
(45) Date of Patent: May 19, 2026

(54) AEROSOL GENERATING APPARATUS AND METHOD OF DETERMINING THE PRESENCE OF AN ARTICLE

(71) Applicant: Nicoventures Trading Limited, London (GB)

(72) Inventors: Patrick Moloney, London (GB); Anton Korus, London (GB)

(73) Assignee: Nicoventures Trading Limited, London (GB)

( * ) Notice: Subject to any disclaimer, the term of this patent is extended or adjusted under 35 U.S.C. 154(b) by 723 days.

(21) Appl. No.: 17/757,456

(22) PCT Filed: Dec. 18, 2020

(86) PCT No.: PCT/GB2020/053297
§ 371 (c)(1),
(2) Date: Jun. 16, 2022

(87) PCT Pub. No.: WO2021/123815
PCT Pub. Date: Jun. 24, 2021

(65) Prior Publication Data

US 2023/0346031 A1 Nov. 2, 2023

(30) Foreign Application Priority Data

Dec. 19, 2019 (GB) ..... 1918808

(51) Int. Cl.
*H05B 6/06* (2006.01)
*A24F 40/42* (2020.01)
(Continued)

(52) U.S. Cl.
CPC ..... *A24F 40/465* (2020.01); *A24F 40/42* (2020.01); *A24F 40/50* (2020.01); *A24F 40/65* (2020.01)

(58) Field of Classification Search
CPC ..... B41F 33/0081; B41P 2233/52; G06K 15/021; G06K 15/027; G06K 2215/0097;
(Continued)

(56) References Cited

U.S. PATENT DOCUMENTS

2016/0150825 A1* 6/2016 Mironov ..... A24F 40/465 219/634

FOREIGN PATENT DOCUMENTS

CN 102186271 A 9/2011
CN 110101117 A 8/2019
(Continued)

OTHER PUBLICATIONS

International Search Report and Written Opinion, International Application No. PCT/GB2020/053297, mailing date Mar. 19, 2021, 66 pages.

(Continued)

*Primary Examiner* — Quang T Van
(74) *Attorney, Agent, or Firm* — BURR & FORMAN LLP

(57) ABSTRACT

An aerosol generating apparatus is provided, including a chamber configured to receive an article including an aerosolizable medium and a detection circuit configured to generate data indicative of the presence of an article comprising an aerosolizable medium within the chamber. The detection circuit can include an inductor and a capacitor arranged in a resonant circuit and a detector configured to measure the resonant frequency of the resonant circuit and output data indicative of the presence of the article in the chamber based on the measured resonant frequency. There is also provided a system for generating aerosol, an article and method of determining the presence of an article including an aerosolizable medium.

12 Claims, 5 Drawing Sheets

(51) Int. Cl.

| | |
|---|---|
| ***A24F 40/46*** | (2020.01) |
| ***A24F 40/465*** | (2020.01) |
| ***A24F 40/50*** | (2020.01) |
| ***A24F 40/65*** | (2020.01) |

(58) Field of Classification Search

CPC . G06T 2207/10004; G06T 2207/30176; G06T 7/0002; A24F 40/20; A24F 40/42; A24F 40/465; A24F 40/50; A24F 40/53; A24F 40/65; A61M 11/042; A61M 15/06; A61M 2205/27; A61M 2205/3317; A61M 2205/6054

USPC ..... 219/628, 629, 634, 635, 630, 601, 667, 219/682, 687

See application file for complete search history.

(56) References Cited

FOREIGN PATENT DOCUMENTS

| | | | |
|---|---|---|---|
| EP | 3145340 | A1 | 3/2017 |
| JP | 2017515488 | A | 6/2017 |
| KR | 20010087105 | A | 9/2001 |
| KR | 20130045167 | A | 5/2013 |
| KR | 20180129637 | A | 12/2018 |
| RU | 2670534 | C1 | 10/2018 |
| UZ | 2268 | C | 2/2003 |
| WO | WO 2018/178113 | A2 | 10/2018 |
| WO | 2018178113 | A3 | 12/2018 |
| WO | WO 2019/122097 | A1 | 6/2019 |
| WO | WO 2019/129843 | A1 | 7/2019 |
| WO | WO 2020/043901 | A1 | 3/2020 |

OTHER PUBLICATIONS

Notice of Reasons for Rejection issued in corresponding Japanese Application No. 2022-537594 on Feb. 20, 2024, all pages cited in their entirety.

Office Action (with translation) issued in Russian Application No. 2022119066 on Jun. 5, 2024, all enclosed pages cited herein.

Office Action (with translation) issued in Korean Application No. 10-2022-7022066 on Dec. 1, 2024, all enclosed pages cited herein.

Non-Final Office Action from corresponding Mexican Application No. MX/a/2022/007675, mailed May 27, 2025, all pages cited in its entirety.

* cited by examiner

AEROSOL GENERATING APPARATUS AND METHOD OF DETERMINING THE PRESENCE OF AN ARTICLE

PRIORITY CLAIM

The present application is a National Phase entry of PCT Application No. PCT/GB2020/053297, filed Dec. 18, 2020, which claims priority from Great Britain Application No. 1918808.5, filed Dec. 19, 2019, each of which is hereby fully incorporated herein by reference.

TECHNICAL FIELD

The present disclosure relates to an aerosol generating apparatus, a system for generating aerosol, an article and a method of determining the presence of an article comprising an aerosolizable medium.

BACKGROUND

Articles such as cigarettes, cigars and the like burn tobacco during use to create tobacco smoke. Attempts have been made to provide alternatives to these articles, which burn tobacco, by creating products that release compounds without burning. Examples of such products are so-called heat-not-burn products, also known as tobacco heating products or tobacco heating devices, which release compounds by heating, but not burning, the material. The material may be, for example, tobacco or other non-tobacco products or a combination, such as a blended mix, which may or may not contain nicotine.

SUMMARY

In a first example, there is provided an aerosol generating apparatus comprising: a chamber configured to receive an article comprising an aerosolizable medium; and a detection circuit configured to generate data indicative of the presence of an article comprising an aerosolizable medium within the chamber, wherein the detection circuit comprises: an inductor and a capacitor arranged in a resonant circuit; and a detector configured to measure the resonant frequency of the resonant circuit and output data indicative of the presence of the article in the chamber based on the measured resonant frequency In a second example, there is provided a system for generating aerosol from an aerosolizable medium, the system comprising: an aerosol generating apparatus according to the first example; and an article comprising an aerosolizable medium.

In a third example, there is provided an article for use with an apparatus according to the first aspect, the article comprising: an aerosolizable medium; and an element for interacting inductively with the inductor such that the resonant circuit oscillates at a shifted resonant frequency different to the resonant frequency at which the resonant circuit oscillates when the chamber is empty.

Further features and advantages of the disclosure will become apparent from the following description of embodiments of the disclosure, given by way of example only, which is made with reference to the accompanying drawings.

DETAILED DESCRIPTION OF THE DRAWINGS

Figure 1:
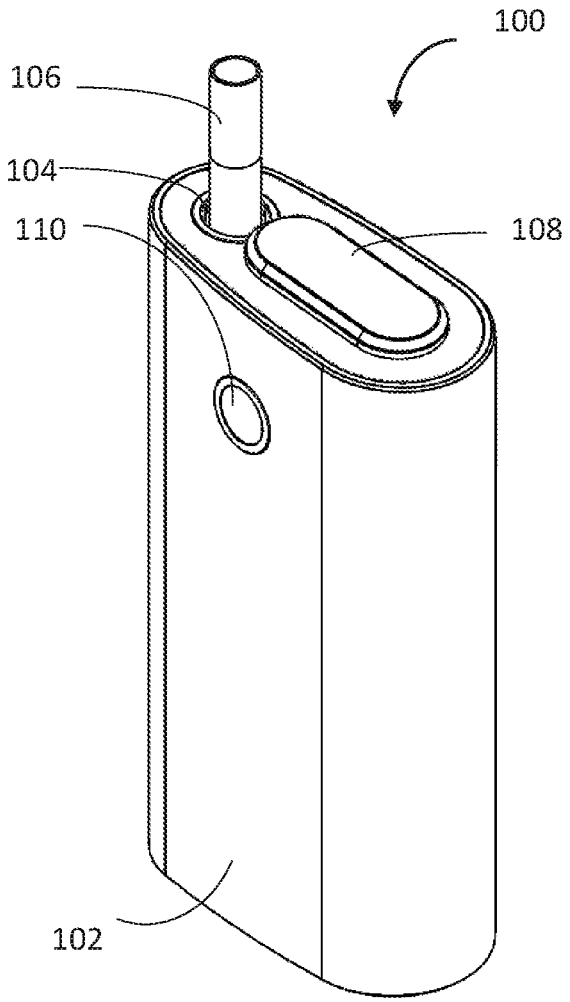
FIG. 1 shows a schematic perspective view of an aerosol generating apparatus, according to an example.

Referring to FIG. 1, a schematic perspective view of an example aerosol generating apparatus is shown. The aerosol generating apparatus is arranged to volatilize at least one component of an aerosolizable medium.

The aerosol generating apparatus comprises a housing 102 and a receptacle, such as a chamber 104, cavity, or holder. The examples described herein are in the context of the receptacle being a chamber, hereafter referred to as the chamber 104.

The chamber 104 is configured to receive an article 106 comprising an aerosolizable medium. Aerosol may be generated from the aerosolizable medium, e.g., through the application of heat to the aerosolizable medium. The aerosol generating apparatus may be configured to deliver the aerosol generated by heating the aerosolizable medium. The article 106 may be a tobacco heating product (THP) article. The aerosol generating apparatus may, for example, be a hand held device for use in providing inhalable aerosol. The aerosol generating apparatus is hereafter referred to as the device 100.

As used herein, the term "aerosolizable medium" (which may also be referred to as "aerosol generating material" or "aerosolizable material") refers to medium or material that provides volatilized components upon the application of energy (e.g., such as heating) in the form of an aerosol. In some embodiments, the aerosol generating material may comprise a tobacco component, wherein tobacco component is any material comprising tobacco or derivatives thereof. The tobacco component may comprise one or more of ground tobacco, tobacco fiber, cut tobacco, extruded tobacco, tobacco stem, reconstituted tobacco and/or tobacco extract. Other types of aerosolizable material may include leaf material, herbal material or organoleptic substances as used in aromatherapy and the like. In some embodiments, the aerosol-generating substrate may comprise a tobacco substitute.

The device 100 in the example of FIG. 1 also has a cover 108. The cover 108 is moveable to cover the chamber 104 when an article, such as the article 106, is not present within the chamber 104. In other examples, the device 100 may not include a cover 108.

In the example of FIG. 1, the device 100 has a power button 110. In use, when the device 100 is switched on using the power button 110, power from a power source (such as a battery within the device 100) is supplied to various components of the device 100. For example, in response to pressing the power button 110, power may flow to a heater such that an article in the chamber 104 is heated and a flow of aerosol is generated from that article.

Figure 2:
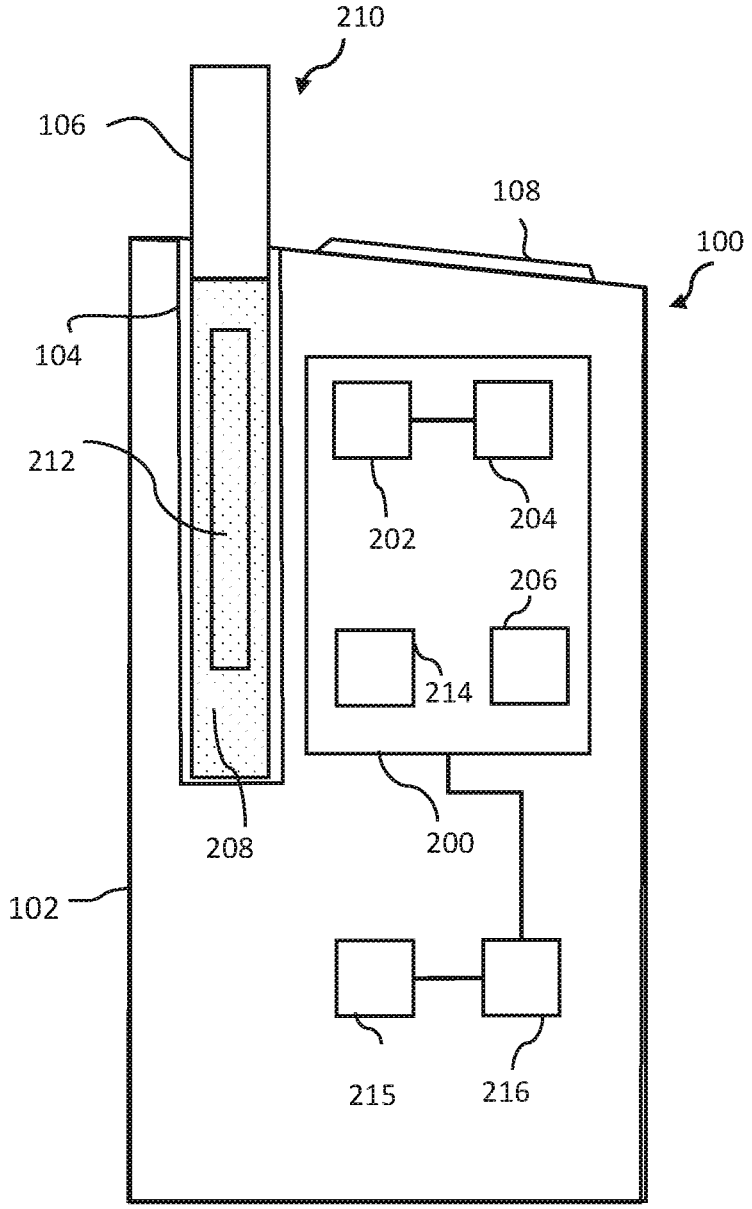
FIG. 2 shows a schematic internal side view of the aerosol generating apparatus of FIG. 1.

FIG. 2 shows an example of an internal side view of the device 100 of FIG. 1, in which certain components are shown as functional blocks. The device 100 comprises a detection circuit 200. The detection circuit 200 is configured to generate data indicative of the presence of an article comprising an aerosolizable medium within the chamber 104. For example, the data may indicate whether or not a particular type of article is present in the chamber, as explained in further detail below.

The detection circuit 200 comprises an inductor 202 and a capacitor 204 arranged in a resonant circuit, for example a circuit as explained in more detail below with reference to FIG. 3. The data indicative of the presence of an article may be data indicative of the resonant frequency of the resonant circuit or other parameters relating to the resonant circuit. In this case, the data may be a direct waveform produced by the resonant circuit, or some characteristic of that waveform. Example characteristics of the waveform include frequency, period, half-period, amplitude decay time constant, and absolute maximum amplitude. The data may also be indicative itself of the presence or characteristics of the article, for example the data may corresponding to a particular article, or whether an article is genuine. A change in resonance due to the presence of an article may be an effective way to determine article characteristics and/or distinguish between genuine and counterfeit articles.

The detection circuit 200 also comprises a detector 206 configured to measure the resonant frequency of the resonant circuit and output data indicative of the presence of the article in the chamber 104 based on the measured resonant frequency. Oscillator systems, such as the resonant circuit, have one or more natural frequencies. If the oscillator system is driven at one of its natural frequencies, resonance occurs. A frequency at which resonance occurs may be called a resonant frequency. Thus, in the present disclosure, the terms "resonant frequency" and "natural frequency" are used interchangeably. The presence of an article in the chamber 104 may influence or interact with the resonant circuit, so that the resonant frequency changes. This change in resonant frequency can be used to identify the presence of an article in the chamber 104 and may also allow distinguishing between different articles based on the change in the resonant frequency.

As described above, the data indicative of the presence of an article may allow determination of the presence of a particular type of article. This is described in further detail below. The device 100 can therefore generate data which indicates information regarding an article inserted in the chamber 104.

In the example of FIG. 2, the article 106 is received in the chamber 104. The article 106 comprises aerosolizable medium 208. Together, the article 106 and the device 100 according to any of the examples described herein form a system 210 for generating aerosol from an aerosolizable medium.

The article 106 is specifically designed for use with the device 100 according to any of the examples described herein, and vice versa. The article 106 may comprise an element 212 for interacting inductively with the inductor 202 such that the resonant circuit oscillates at a shifted, changed or adjusted resonant frequency different to the resonant frequency at which the resonant circuit oscillates when the chamber 104 is empty. The element 212 may comprise any material which is excited in the presence of a varying magnetic field. For example, the element 212 may comprise a material which experiences hysteresis and/or eddy currents in the presence of a varying magnetic field. Examples of materials for element 212 include electrically conductive materials and ferrous materials. Examples of materials include mild steel, ferrous steel with an anti-corrosion coating (for example nickel and cobalt), ferritic stainless steel (for example so called "400 series" steel), aluminum, gold, silver, non-ferritic stainless steel, copper, brass, and chrome. In other embodiments, alloys may be formulated for the primary purpose of having an effect on the resonant frequency. The element 212 may be discrete, or integrated or incorporated in other components, such as a paper wrapping the article, the aerosolizable medium 208, etc.

The resonant frequency of the resonant circuit may change based on an inductive interaction between the inductor 202 and the element 212 associated with the article 106. Therefore, the presence of the article 106 within the chamber 104 causes a change/shift in the resonant frequency of the resonant circuit. In other words, when the article 106 is inserted into the chamber 104, the detector 206 measures a different resonant frequency to the case in which the article 106 is not inserted in the chamber 104.

For example, when the article 106 is inserted into the chamber 104, the arrangement of the system 210 is such that the element 212 is positioned to interact with a magnetic field generated by the inductor 202 (e.g., when a current flows in the inductor 202). The presence of the element 212 changes the permeability associated with the inductor 202, which in turn causes a change in the inductance of the inductor 202 and therefore the resonant frequency of the resonant circuit. In this way, the presence of the element 212 shifts the resonant frequency of the resonant circuit.

The system 210 may be arranged such that, when the article 106 is received in the chamber 104, the article 106 occupies at least a part of a core region of the inductor 202. For example, the inductor 202 may be a coil extending around the chamber 104 so that the article is 106 is located inside the coil when inserted into the chamber 104. This can mean that the inductance, and therefore the resonant frequency changes to a greater extent than if the same element 212 was located in a different position. This is because the magnetic flux density of the magnetic field generated by the inductor 202 may be greatest in the core region of the inductor 202. Therefore, the inductive interaction between the element 212 and the inductor 202 may be maximized by positioning the element 212 within the core region of the inductor 202. This can allow use of smaller elements 212 for the same change in resonant frequency, reducing production costs.

The detection circuit 200 may comprise an initiator 214 configured to cause the resonant circuit to oscillate at the resonant frequency. The detection circuit 200 may be configured to measure the resonant frequency responsive to the initiator causing the resonant circuit to oscillate at the resonant frequency. The initiator 214 allows initiation of the oscillation of the resonant circuit at the resonant frequency which can then be measured. The provision of the initiator 214 means that oscillation at the resonant frequency can be initiated at a time when the generation of the data indicative of the presence of an article is desired. In some examples, the resonant circuit is only caused to oscillate when detection or identification is desired, for example at the start of a use session of the device 100. In other examples, detection or identification may be carried out periodically, intermittently or continuously, for example continuously throughout a use session. This can be useful to ensure that a genuine consumable is not used initially at the start of a use session and then substituted for a counterfeit consumable, for example.

Figure 3:
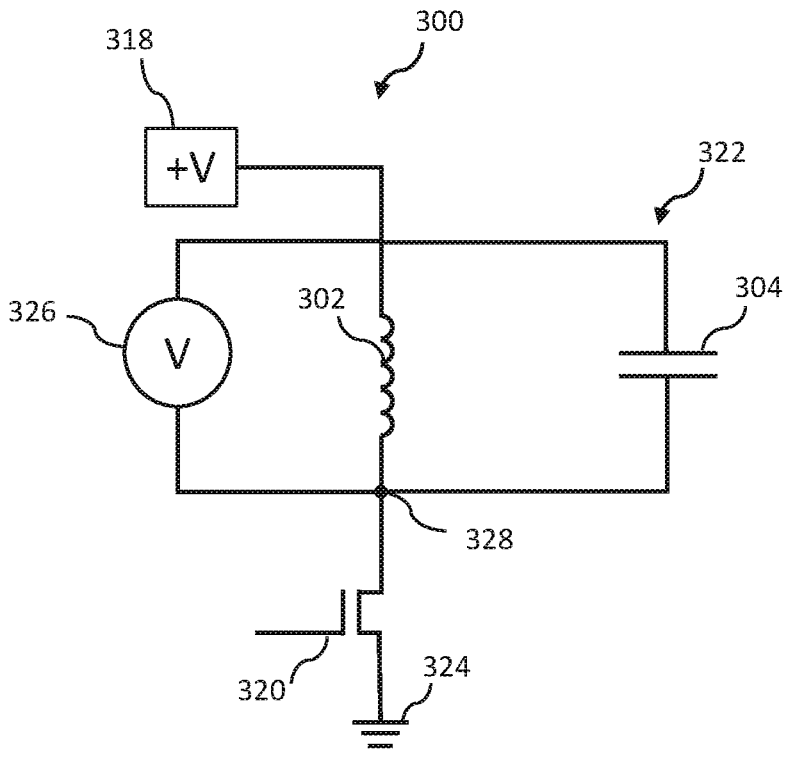
FIG. 3 shows a schematic diagram of a detection circuit, according to an example.

FIG. 3 shows a schematic diagram of an example of a detection circuit 300. In the example of FIG. 3, there is an initiator comprises a power supply 318 and a switch element 320. The switch element 320 is controlled to selectively cause a direct current driven by the power supply 318 to flow in the inductor 302, thereby to initiate oscillation of the resonant circuit 322 at the resonant frequency, for example by causing a steady state current through the inductor to be switched off. The power supply 318 may be the power source described above. For example, the device 100 may comprise a battery as the power source which supplies power to the various components of the device 100 including the detection circuit 200. In other examples, the power supply 318 may be derived from a battery, for example through a DC-DC converter. This may allow the power supply 318 to be at a different voltage than the battery.

In the example of FIG. 3, the power supply 318 supplies electrical power to one side of the resonant circuit 322, which in this example is a parallel LC circuit. The switch element 320 connects the other side of the resonant circuit 322 to ground 324. Thus, the switch element can selectively connect the inductor 302 and the capacitor 304 to ground 324 and selectively disconnect the inductor 302 and the capacitor 304 from ground. This selective connection and disconnection can provide a simple way to initiate oscillation so that the resonant frequency may be measured.

The switch element 320 may be any kind of switch element, for example a transistor or a relay. In the particular example of FIG. 3, the switch element 320 is a field effect transistor (FET) such as a metal-oxide-semiconductor field effect transistor (MOSFET). FETs and MOSFETS have the advantage that they can be designed and fabricated in a single chip with other circuitry and can be very small. Use of the FET may provide an arrangement with reduced physical size as compared to some other types of switching elements. The reduced physical size may be particularly advantageous for the device 100 which is a hand held device.

The resonant circuit 322 may be caused to oscillate at the resonant frequency by the initiator in the following manner. First, the FET 320 is switched on so as to cause a direct current driven by the power supply 318 to flow through the inductor 302 to ground 324. When first switched on, a transient effect will be present, as the inductor resists the change in current flowing through it. Over time that transient effect reduces and the current through the inductor will tend towards a steady state. In the steady state a direct current is flowing in the inductor 302 and energy is stored in an associated magnetic field. Likewise, the capacitor will also experience a transient effect as initially a current flows across the capacitor. Over time that transient effect is reduced and current flowing across the capacitor will tend towards a steady state of zero current. In the steady state the capacitor has a voltage across it and energy is stored in an associated electric field.

After being on for a given period of time which is sufficient for the inductor to reach or approach a steady state, for example within about 10% or about 5% of the steady state current, the FET 320 is switched off such that the resonant circuit 322 is disconnected from ground 324. The energy stored in the inductor 302 in the form of a magnetic field and the energy stored in the capacitor in the form of an electric field may then oscillate between the inductor 302 and the capacitor 304. As in this case the resonant circuit 322 is not being driven, the resonant circuit 322 will oscillate at its natural frequency.

The detection circuit 300 comprises a detector device for measuring one or more parameters indicative of the resonant frequency. In the present disclosure, measuring the resonant frequency includes measuring any parameter from which the resonant frequency can be derived. In the example of FIG. 3, a voltmeter 326 is provided as the detector device. The voltmeter 326 may measure the voltage across the inductor 302 and capacitor 304 (as shown), or between the bottom node 328 (which is the lower connection between the inductor 302 and the capacitor 304 as shown in FIG. 3) and ground 324, which voltage oscillates in correspondence with the oscillation of energy between the inductor 302 and the capacitor 304. The frequency can be measured by observing the value read by the voltmeter.

The potential difference or voltage measured by the voltmeter 326 with respect to time may be output as the data indicative of the resonant frequency, for example as a waveform. In some examples, the detection circuit 200 may comprise other components which output data based on the measured voltage rather than outputting the measured voltage directly. For example, the detection circuit 200 may include a circuit arrangement (not shown) which receives the measured voltage with respect to time (e.g., the above-described waveform), determines the resonant frequency, and outputs data indicative of the resonant frequency (e.g., the data may represent a frequency value in hertz, the time period associated with the oscillation, or the like). In examples where the measured voltage with respect to time is output, a processor of the device 100 (described further below) may determine the resonant frequency from the data. For example, the time between consecutive zero crossings of the voltage signal may be measured and used to calculate the frequency, because the time between successive zero crossings will be half a period at the resonant frequency.

The given period of time (for which the FET 320 remains on before being switched off to cause the oscillation) may be selected such that sufficient time is allowed for the inductor 302 to build up energy in its magnetic field to substantially the maximum amount of energy it is capable of storing given the characteristics of the power supply 318. The given period of time may depend on the characteristics of the inductor 302, and, potentially, other components within the detection circuit 300 or in close proximity to the detection circuit 300 (e.g., other components of the device 100 with magnetic properties). Allowing the inductor 302 to store more energy may allow a greater amplitude oscillation in the resonant circuit 322, so that the resonant frequency can be measured with better accuracy.

In some examples, the given period of time may be less than the amount of time required to reach a state for the inductor 302 to store substantially maximum energy but nevertheless sufficient energy may be stored to allow at least one half period of oscillations to be measured for the determination of the resonant frequency.

Once oscillating, the absence of any further driving results in the resonant circuit 322 dissipating energy over time due to damping. The amplitude of the oscillations therefore decreases over time. The amount of damping may, for example, depend on the characteristics of the element 212 or even other components of the article 106. For example, energy may be dissipated to the element 212 due to the inductive interaction between the element 212 and the inductor 302.

Figure 4:
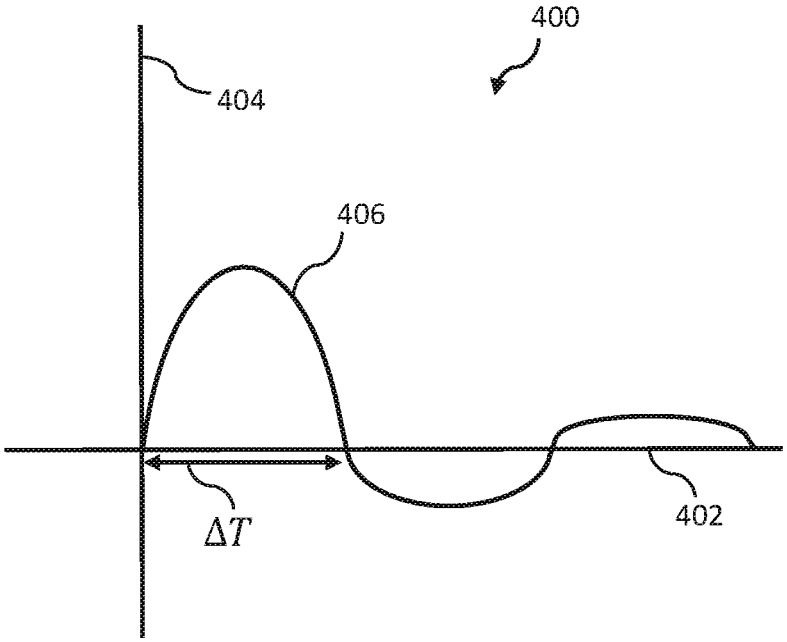
FIG. 4 shows a sketch of a graph of a measured voltage with respect to time, according to an example.

FIG. 4 depicts an example of a voltage signal as measured by the voltmeter 326, when the voltmeter measures the voltage between the node 328 and ground. The horizontal axis 402 represents time and the vertical axis 404 represents amplitude of the measured voltage. A trace 406 indicates the measured voltage with respect to time. The trace 406 shows a part of a sinusoidal oscillation of the measured voltage corresponding to the oscillation of the resonant circuit 322, which oscillation decays with time as described above. The oscillation starts at zero because at the point the switching element is turned off, the voltage between the node 328 and ground is zero. Depending on which voltage is measured the measured initial value may also be non-zero.

In some examples, the resonant frequency may be determined based on a determination of half the period of the sinusoidal oscillation labelled as ΔT in FIG. 4. For example, the value of the frequency of the sinusoidal oscillation shown may be determined in Hertz as 1/(2×ΔT)

The sinusoidal oscillation shown in FIG. 4 decays with time. In examples where the measured voltage with respect to time is directly output as the data, information relating to the decay is included in the data. In other examples, the data output by the detection circuit 200 may include information regarding the decay, e.g., a time constant associated with the decay shown. As described, the resonant frequency allows for determinations relating to an article inserted in the chamber 104. The information regarding the decay may be alternatively or additionally to the resonant frequency to determine characteristics of an article inserted in the chamber 104 in some examples.

In some examples, the resonant circuit 322 may be configured to also heat a suspector element. In this way, the inductor 302 can additionally function as a heater which inductively provides energy for heating the susceptor element. For this purpose, the resonant circuit 322 may be driven using an alternating current. For example, the switch element may be selectively operated to drive the resonant circuit at its resonant frequency, rather than initiate a damped oscillation as used for detecting and/or identifying an article 106. Alternatively or additionally, further components may be provided to drive the inductor when used as a heater, such a separate power supply and associated drive circuitry.

Induction heating is a process in which an electrically-conductive object is heated by penetrating the object with a varying magnetic field. The process is described by Faraday's law of induction and Ohm's law. An induction heater may comprise an electromagnet and a device for passing a varying electrical current, such as an alternating current, through the electromagnet. When the electromagnet and the object to be heated are suitably relatively positioned so that the resultant varying magnetic field produced by the electromagnet penetrates the object, one or more eddy currents are generated inside the object. The object has a resistance to the flow of electrical currents. Therefore, when such eddy currents are generated in the object, their flow against the electrical resistance of the object causes the object to be heated. This process is called Joule, ohmic, or resistive heating. An object that is capable of being inductively heated is known as a susceptor.

It has been found that, when the susceptor is in the form of a closed electrical circuit, magnetic coupling between the susceptor and the electromagnet in use is enhanced, which results in greater or improved Joule heating.

Magnetic hysteresis heating is a process in which an object made of a magnetic material is heated by penetrating the object with a varying magnetic field. A magnetic material can be considered to comprise many atomic-scale magnets, or magnetic dipoles. When a magnetic field penetrates such material, the magnetic dipoles align with the magnetic field. Therefore, when a varying magnetic field, such as an alternating magnetic field, for example as produced by an electromagnet, penetrates the magnetic material, the orientation of the magnetic dipoles changes with the varying applied magnetic field. Such magnetic dipole reorientation causes heat to be generated in the magnetic material.

When an object is both electrically-conductive and magnetic, penetrating the object with a varying magnetic field can cause both Joule heating and magnetic hysteresis heating in the object. Moreover, the use of magnetic material can strengthen the magnetic field, which can intensify the Joule and magnetic hysteresis heating.

In each of the above processes, as heat is generated inside the object itself, rather than by an external heat source by heat conduction, a rapid temperature rise in the object and more uniform heat distribution can be achieved, particularly through selection of suitable object material and geometry, and suitable varying magnetic field magnitude and orientation relative to the object. Moreover, as induction heating and magnetic hysteresis heating do not require a physical connection to be provided between the source of the varying magnetic field and the object, design freedom and control over the heating profile may be greater, and cost may be lower.

In the examples, described herein, the inductor 302 may perform the function of the described electromagnet by generating a varying magnetic field when an alternating current flows through it.

In some examples, a varying magnetic field generated by the inductor responsive to an alternating current flowing therethrough may cause Joule heating and/or magnetic hysteresis heating in a susceptor.

The device 100 may comprise the susceptor element. For example, the device 100 may comprise a tube suitable for use as a susceptor surrounding the chamber 104. The inductor may heat the tube so as to provide heat to the aerosolizable medium 208 to volatilize at least one component of the aerosolizable medium 208. In other examples, the device 100 may comprise various other different susceptor elements.

In some examples, the susceptor element may be provided as part of the article 106. For example, a susceptor element may be provided within the article 106 in close proximity to the aerosolizable medium 208. In some examples, the aerosolizable medium 208 may have distributed therethrough particles, flakes, or the like, which function as susceptors. The susceptor may, for example, comprise one or more of the following materials: aluminum, gold, iron, nickel, cobalt, conductive carbon, graphite, plain-carbon steel, stainless steel, ferritic stainless steel, copper, and bronze.

In some examples, the element 212 described above and which functions to allow the article to be detected and/or identified may also function as a susceptor element. For example, the element 212 may cause a change in the resonant frequency of the resonant circuit 322 in order for the determination of the presence of the article as described herein to take place. In addition, the element 212 may also be inductively heated by the inductor so as to heat the aerosolizable medium 208 for aerosol generation. In such examples, the element 212 may comprise a material which exhibits hysteresis and/or eddy currents in the presence of a varying magnetic field sufficient so as to heat the aerosolizable medium in question. The material is also suitable for allowing the article to be detected and/or identified as described above. Examples of materials include mild steel, ferrous steel with an anti-corrosion coating (e.g., nickel, cobalt, etc.), ferritic stainless steel (such as so called "400 series" steels) and aluminum.

The resonant circuit 322 being configured to heat a susceptor element means that a single circuit can be used for two different functions; both heating the aerosolizable medium and use in determining the presence and/or identity of an article within the chamber 104. This may reduce the amount of circuitry/components which are included as part of the device 100, saving resources and allowing fewer size restrictions with the device 100 (e.g. the device 100 may be made smaller).

Referring again to FIG. 2, in some examples, the device 100 may comprise a memory 215 having stored thereon predetermined data, such as a look up table matching resonant frequency to known articles and/or article characteristics, such as heating profiles, and a processor 216 in data communication with the memory 215. The processor 216 may be configured to receive the data indicative of the presence of the article, and determine an article characteristic based on the received data and the predetermined data. The predetermined data may be an exact measurement, for example a particular frequency. Alternatively or additionally, some or all of the predetermined data may be expressed as a range, which allows for greater tolerances in detection. Different tolerances of detection may be applied to different characteristics which may be measured by the detection circuit. For example, the frequency can generally be measured more accurately than an amplitude decay time constant so greater tolerance may be used for the amplitude decay time constant.

The processor 216 may determine the resonant frequency of the resonant circuit. In examples where the data is a waveform of the measured voltage with respect to time, the processor 216 may determine the resonant frequency from the waveform, for example, by determining the value of half the period of the oscillation $\Delta T$, and then calculating the corresponding frequency as described above. Alternatively, the value of $\Delta T$ itself may be used directly, for example in a look up table.

As described above, in some examples the output of the detector circuit may be data representative of a frequency value in hertz, the time period associated with the oscillation, or the like. In these examples, the processor 216 may perform any further calculations needed to arrive at the resonant frequency (e.g., calculate the inverse of the time period of the oscillation if the data indicates the time period). In some examples, the processor 216 may determine the resonant frequency using a number of received units of data (e.g., by taking an average).

The predetermined data may comprise data corresponding to respective articles. For example, there may be predetermined data corresponding to articles with which the device 100 is intended to be used; this may distinguish over counterfeit articles or articles which are intended for use with a different device, for example. For example, the predetermined data may comprise a non-counterfeit range of resonant frequencies within which the received data is expected to be for non-counterfeit articles. This may be the case, for example, where the device 100 is intended to be used with a plurality of different articles. The processor 216 may compare the received data with the predetermined data and determine whether or not a non-counterfeit article is present in the chamber 104. For example, if the received data is indicative of a resonant frequency within the non-counterfeit range of resonant frequencies, the processor 216 may determine that a non-counterfeit (i.e., genuine article) is present. Whether or not an inserted article is genuine or counterfeit is an example of an article characteristic.

In some examples, the predetermined data may be indicative of other article characteristics. For example, the predetermined data may correspond to articles with different types and/or amounts of aerosolizable medium. Other examples of article characteristics include a particular flavorant present in the aerosolizable medium, a batch/serial number of the article present in the chamber 104, and the like.

By comparing the received data with the predetermined data, it is possible to determine various article characteristics of an article received in the chamber 104. The processor 216 may be configured to determine one or more aspects of the operation of the device 100 based on the determined article characteristic.

For example, if it is determined that a counterfeit article has been inserted into the chamber 104, the processor 216 may issue a notification to that effect. The device 100 may comprise an indicator configured to indicate information to the user of the device 100. The notification may be provided to the user by means of the indicator. For example, the indicator may be visual, such as a display screen or one or more indicator lights, audible, such as a speaker or buzzer, haptic, such as a vibration motor. Taking the example of a display screen, when a counterfeit article is detected, the display screen may show a symbol, one or more suitable words, etc., which indicate to the user that the article inserted in the chamber 104 is counterfeit.

Alternatively, or in addition, the device 100 may comprise a transmitter for transmitting information to a remote apparatus. The described notification may be transmitted to the remote apparatus using the transmitter. For example, the transmitter may be a wireless transmitter using standards according to IEEE 802.15 (Bluetooth), IEEE 802.11 (WiFi), and mobile communication standards, such as those set by 3GPP. The remote apparatus may be a mobile phone, a personal computer or a server linked to the manufacturer of the device 100.

In some examples, the processor 216 may determine other aspects of operation based on the determined article characteristic. For example, the processor 216 may control the heater of the device 100 in a manner depending on the type and/or amount of aerosolizable medium (or depending on any other article characteristic which it is advantageous to consider when determining how to operate the heater). The processor 216 may cause the heater of the device 100 to operate according to a particular heating profile depending on the type and/or amount of aerosolizable medium, for example. In this way, the device 100 may be caused to operate in a manner that is optimal for the particular article received in the chamber 104.

The processor 216 may be configured to cause the detection circuit 200 to measure the resonant frequency and output the data indicative of the presence of the article in the chamber 104. For example, when the detection circuit is the detection circuit described above with reference to FIG. 3, the processor 216 may control the FET 320 in order to cause the resonant circuit 322 to oscillate at its resonant frequency. The processor 216 may cause an appropriate voltage to be applied to the gate terminal of the FET 320 to cause it to switch on, and after the above-described given period of time, the processor 216 may cause an appropriate voltage to be applied to the gate terminal of the FET 320 to cause it to switch off. As described, this would cause the resonant circuit 322 to oscillate at its resonant frequency. The processor 216 may then cause data to be output from the detector device. In the example of the detector device being a voltmeter 326 as described above, the processor 216 may sample the measured voltage at predetermined intervals using an analog to digital converter, thereby to acquire a representation of the voltage over time. The predetermined intervals may be set so that they correspond to the Nyquist frequency of a maximum frequency to be measured, for example.

The processor 216 controls the FET 320 and therefore allows control over when the resonant frequency is measured. In some examples, the device 100 may comprise an article insertion detector which provides an article insertion signal when something is inserted into the chamber 104. For example, there may be an electronic switch which is switched on/off when an end of an article passes a part of the chamber 104, when the cover 108 is moved so that the chamber 104 is no longer covered, etc. The processor 216 may cause the detection circuit 200 to measure the resonant frequency and output the data indicative of the presence of the article in the chamber 104 when it receives the article insertion signal from the article insertion detector (for example, after a suitable time delay after receipt of the article insertion signal).

In other examples, the processor 216 may cause the resonant frequency to be measured and the data indicative of the presence of an article in the chamber 104 to be output at other times, as desired. For example, the processor 216 may control the detection circuit 200 to operate after the power button 110 is actuated to initiate use of the device 100.

Figure 5:
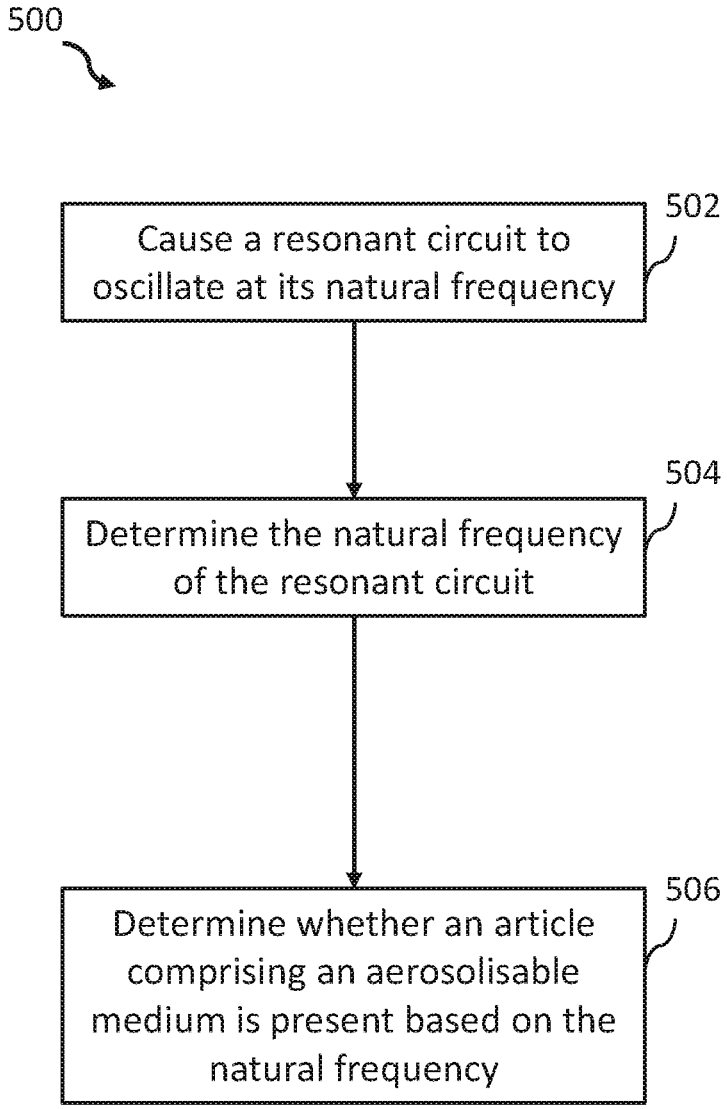
FIG. 5 shows a block diagram illustrating a method of determining the presence of an article comprising an aerosolizable medium within a chamber, according to an example.

FIG. 5 is flow diagram illustrating a method 500 of determining the presence of an article comprising an aerosolizable medium within a chamber. For example, the method 500 may be for determining the presence of an article within the chamber 104 of the device 100. The method 500 may be performed using the detection circuit 200 described above, for example. At block 502 of the method 500, a resonant circuit is caused to oscillate at its natural frequency. For example, the processor 216 may cause the resonant circuit 322 to oscillate at its natural frequency as described above.

At block 504, the natural frequency of the resonant circuit is determined. For example, the processor 216 may determine the natural frequency using the received data as described above. At block 506, whether an article comprising an aerosolizable medium is present is determined based on the natural frequency. As described above, presence of a particular type of article may be determined. The processor 216 may make this determination by, for example, determining one or more article characteristics based on the resonant frequency.

As such, the method 500 may also comprise determining an article characteristic based on a comparison between the determined natural frequency and predetermined data. The predetermined data may be the predetermined data stored on the memory 215 as discussed above. The article characteristic may include whether or not an article received in the chamber is counterfeit, type and/or amount of aerosolizable medium, etc., as discussed above. The determination of the article characteristic may be part of the determination of the presence of an article in block 506.

The method 500 may also comprise controlling the operation of the device 100 based on the determined article characteristic. For example, as described above, the processor 216 may provide a notification and/or control the heater of the device 100 based on the determined article characteristic.

The method 500 may include determining the presence of an article comprising aerosolizable medium within the chamber 104 responsive to an article insertion signal. For example, as described above, the processor 216 may receive the article insertion signal and in response (e.g. after a suitable time delay) cause the detection circuit 200 to measure the natural frequency and output the data indicative of the presence of an article.

As used herein, the terms "flavor" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, solid, or powder. For example, a liquid, oil, or other such fluid flavorant may be impregnated in a porous solid material to impart flavor and/or other properties to that porous solid material. As such, the liquid or oil is a constituent of the solid material in which it is impregnated.

The above examples are to be understood as illustrative examples of the disclosure. Further examples of the disclosure are envisaged. It is to be understood that any feature described in relation to any one example may be used alone, or in combination with other features described, and may also be used in combination with one or more features of any other of the examples, or any combination of any other of the examples. Furthermore, equivalents and modifications not described above may also be employed without departing from the scope of the disclosure.

The invention claimed is:

1. An aerosol generating apparatus comprising:

a chamber configured to receive an article comprising an aerosolizable medium; and a detection circuit configured to generate data indicative of the presence of an article comprising an aerosolizable medium within the chamber, wherein the detection circuit comprises:

an inductor and a capacitor arranged in a resonant circuit; and a detector configured to measure a resonant frequency of the resonant circuit and output data indicative of the presence of the article in the chamber based on the measured resonant frequency.

2. The aerosol generating apparatus according to claim 1, wherein the detection circuit comprises:

an initiator configured to cause the resonant circuit to oscillate at the resonant frequency;

wherein:

the detection circuit is configured to measure the resonant frequency responsive to the initiator causing the resonant circuit to oscillate at the resonant frequency.

3. The aerosol generating apparatus according to claim 2, wherein the initiator comprises:

a power supply; and a switch element, wherein:

the switch element is controlled to selectively cause a direct current driven by the power supply to flow in the inductor, thereby to initiate oscillation of the resonant circuit at the resonant frequency.

4. The aerosol generating apparatus according to claim 3, wherein the switch element is a field effect transistor.

5. The aerosol generating apparatus according to claim 1, wherein:

the resonant circuit is configured to heat a susceptor element.

6. The aerosol generating apparatus according to claim 1, comprising:

a memory having stored thereon predetermined data; and a processor in data communication with the memory, the processor being configured to:

receive the data indicative of the presence of the article; and determine an article characteristic based on the received data and the predetermined data.

7. The aerosol generating apparatus according to claim 6, wherein the processor is configured to determine one or more aspects of the operation of the aerosol generating apparatus based on the determined article characteristic.

8. The aerosol generating apparatus according to claim 6, wherein the processor is configured to:

cause the detector to measure the resonant frequency and output the data indicative of the presence of the article in the chamber.

9. An article for use with the apparatus according to claim 1, the article comprising:

an aerosolizable medium; and an element for interacting inductively with the inductor such that the resonant circuit oscillates at a shifted resonant frequency different to the resonant frequency at which the resonant circuit oscillates when the chamber is empty.

10. A system for generating aerosol from an aerosolizable medium, the system comprising:

an aerosol generating apparatus comprising a chamber configured to receive an article comprising an aerosolizable medium and a detection circuit configured to generate data indicative of the presence of an article comprising an aerosolizable medium within the chamber, wherein the detection circuit comprises an inductor and a capacitor arranged in a resonant circuit and a detector configured to measure a resonant frequency of the resonant circuit and output data indicative of the presence of the article in the chamber based on the measured resonant frequency; and an article comprising an aerosolizable medium.

11. The system according to claim 10, wherein:

the article comprises an element which changes the resonant frequency of the resonant circuit based on an inductive interaction between the inductor and the element.

12. The system according to claim 10, wherein:

when the article is received in the chamber, the article occupies at least a part of a core region of the inductor.

* * * * *